US012788139B2

(12) United States Patent
Kroon et al.

(10) Patent No.: US 12,788,139 B2
(45) Date of Patent: Nov. 10, 2026

(54) PORTABLE WORK STATION WITH INTEGRATED MONITOR AND POWER SOURCE

(71) Applicant: August Berres Corporation, Lewes, DE (US)

(72) Inventors: Robert Kroon, South San Francisco, CA (US); Robert Russell, Kentwood, MI (US); Sterling Pau, Vancouver, WA (US)

(73) Assignee: August Berres Corporation, Lewes, DE (US)

( * ) Notice: Subject to any disclaimer, the term of this patent is extended or adjusted under 35 U.S.C. 154(b) by 138 days.

(21) Appl. No.: 18/668,377

(22) Filed: May 20, 2024

(65) Prior Publication Data

US 2024/0402759 A1 Dec. 5, 2024

Related U.S. Application Data

(60) Provisional application No. 63/504,804, filed on May 30, 2023.

(51) Int. Cl.
*A47B 21/04* (2006.01)

(52) U.S. Cl.
CPC ..... *A47B 21/04* (2013.01)

(58) Field of Classification Search
CPC ..... A47B 21/04; A47B 21/02; A47B 21/03; A47B 21/0314; A47B 2200/0076; A47B 2021/0364; A47B 2021/066; A47B 2200/0075; A47B 2200/008; A47B 2200/0023; B62B 3/02; B62B 3/00; B62B 2202/56; B62B 2202/61; A61B 50/13
USPC ..... 108/50.02, 50.01, 150, 151, 152, 149; 280/47.35, 47.34; 361/679.02, 679.01, 361/679.08, 679.21; 312/223.3, 223.6
See application file for complete search history.

(56) References Cited

U.S. PATENT DOCUMENTS

| | | | | |
|---|---|---|---|---|
| 4,388,786 | A | 6/1983 | Gassler | |
| 4,606,394 | A | 8/1986 | Bannister | |
| D393,382 | S * | 4/1998 | Rutter | D6/655 |
| 6,216,398 | B1 | 4/2001 | Shipman et al. | |
| 7,106,014 | B1 * | 9/2006 | Mastalir | A47B 19/06 361/679.2 |

(Continued)

FOREIGN PATENT DOCUMENTS

| | | | | |
|---|---|---|---|---|
| CN | 218739142 U * | 3/2023 | | A61B 50/13 |
| EP | 3168958 A1 * | 5/2017 | | H02J 7/0071 |

(Continued)

OTHER PUBLICATIONS

CN 218739142 English translation (Year: 2023).*

*Primary Examiner* — Janet M Wilkens
(74) *Attorney, Agent, or Firm* — HONIGMAN LLP; Eric J. Sosenko

(57) ABSTRACT

A portable work station includes a base, a column extending from the base, and a battery pack accommodated by the column. The base includes a plurality of wheels for moving the portable work station within an environment. A mounting plate is disposed at an end of the column distal from the base. The battery pack is operable to electrically power one or more electronic devices disposed at the portable work station. A monitor is removably mounted at the mounting plate and the battery pack is operable to electrically power the monitor.

20 Claims, 12 Drawing Sheets

(56) References Cited

U.S. PATENT DOCUMENTS

| | | | | |
|---|---|---|---|---|
| 7,640,866 | B1 * | 1/2010 | Schermerhorn | A47B 21/00 108/5 |
| 7,762,023 | B2 | 7/2010 | Kasdorf et al. | |
| 9,775,430 | B2 * | 10/2017 | Abu-Akel | A47B 21/02 |
| 10,485,335 | B1 * | 11/2019 | Johnson | F16M 11/28 |
| D1,001,798 | S * | 10/2023 | Yuan | D14/373 |
| 2001/0017009 | A1 | 8/2001 | Lininger et al. | |
| 2001/0025460 | A1 | 10/2001 | Auer et al. | |
| 2002/0023391 | A1 | 2/2002 | Nymark | |
| 2003/0039507 | A1 | 2/2003 | Liu | |
| 2003/0163967 | A1 | 9/2003 | Sims | |
| 2005/0275178 | A1 * | 12/2005 | Huesdash | F16M 11/42 280/47.35 |
| 2007/0001413 | A1 * | 1/2007 | Rossini | F16M 11/42 280/47.35 |
| 2008/0116327 | A1 * | 5/2008 | Goldberg | A47B 21/00 248/121 |
| 2010/0080970 | A1 | 4/2010 | Hayes et al. | |
| 2011/0102984 | A1 * | 5/2011 | Pfister | F16M 11/10 361/679.01 |
| 2012/0312196 | A1 * | 12/2012 | Newkirk | H02J 7/00045 108/50.02 |
| 2017/0141597 | A1 * | 5/2017 | Mifsud | H02J 7/0013 |
| 2017/0328127 | A1 * | 11/2017 | Stathis | F21S 6/003 |
| 2022/0251832 | A1 | 8/2022 | Kroon et al. | |
| 2023/0090013 | A1 * | 3/2023 | Christensen | F16M 11/041 248/125.8 |
| 2023/0225504 | A1 * | 7/2023 | Pan | G06F 1/1601 248/124.1 |
| 2024/0407543 | A1 * | 12/2024 | Mensing | A47B 21/04 |
| 2025/0251075 | A1 * | 8/2025 | Gagne | A47B 57/485 |

FOREIGN PATENT DOCUMENTS

| | | | | |
|---|---|---|---|---|
| GB | 2628945 | A * | 10/2024 | A47B 21/04 |
| WO | WO-2004017831 | A1 * | 3/2004 | A61B 5/7435 |
| WO | WO-2020014283 | A1 * | 1/2020 | B25H 1/12 |
| WO | WO-2023056144 | A1 * | 4/2023 | A47B 21/02 |

* cited by examiner

PORTABLE WORK STATION WITH INTEGRATED MONITOR AND POWER SOURCE

CROSS REFERENCE TO RELATED APPLICATION

The present application claims the filing benefits of U.S. provisional application Ser. No. 63/504,804, filed May 30, 2023, which is hereby incorporated herein by reference in its entirety.

FIELD OF THE INVENTION

The present invention relates generally to furniture and, more particularly, to portable workspace assemblies.

BACKGROUND OF THE INVENTION

Modular furniture is generally known in the art.

SUMMARY OF THE INVENTION

A rechargeable and portable work station includes a base. The base includes a plurality of wheels for moving the portable work station within an environment. A column extends from the base, and a mounting plate is disposed at an end of the column distal from the base. A battery pack is accommodated by the column. The battery pack, with a monitor mounted at the mounting plate, electrically powers the monitor. The portable work station is modular and may be reconfigured, such as based on a desired size of the monitor mounted at the end of the column, based on power requirements for the monitor and user devices at the work station and based on a desired height of a work surface removably mounted along the column (e.g., a standing height or a sitting height). The portable work station may be used in an office or manufacturing setting (e.g., a portable work station with power supply), a retail setting (e.g., a portable display device or digital menu board), a trade show setting (e.g., a portable interactive display), a classroom setting (e.g., a portable teaching and display tool), a hospital setting (e.g., a portable nurse station) and the like.

These and other objects, advantages, purposes and features of the present invention will become apparent upon review of the following specification in conjunction with the drawings.

DESCRIPTION OF THE PREFERRED EMBODIMENTS

Figure 1:
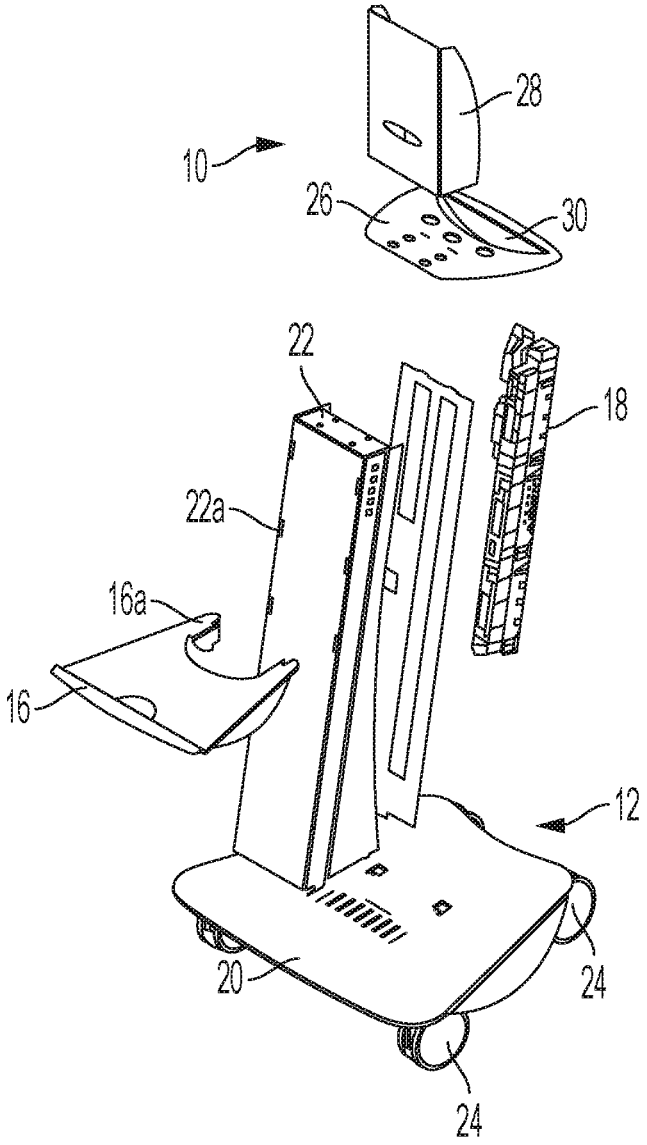
FIG. 1 is an exploded view of a portable work station having a rechargeable battery pack accommodated within a column of the work station, a work surface that removably attaches along the column and a mounting bracket that receives a display monitor.
Figure 3:
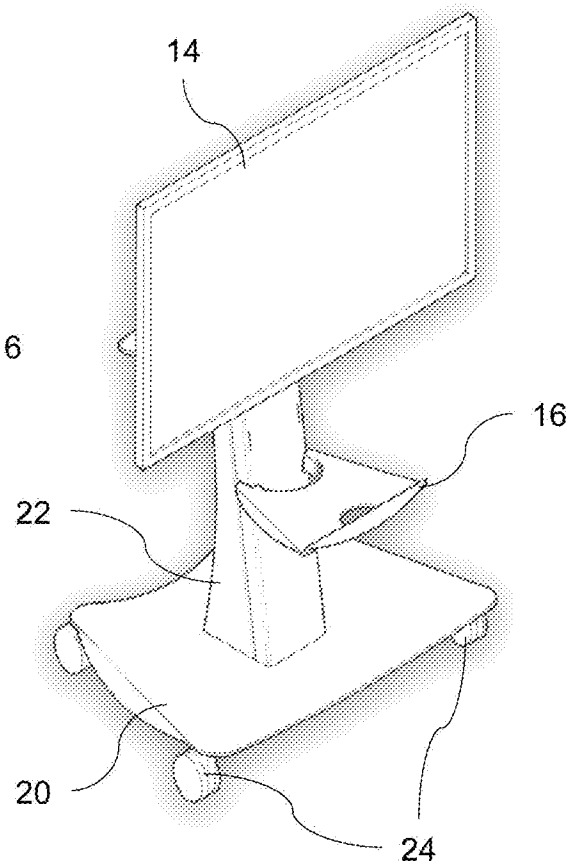
FIGS. 2-10 are perspective views of the portable work station with different configurations of the base, the work surface, and one or more monitors attached at the mounting bracket.
Figure 2:
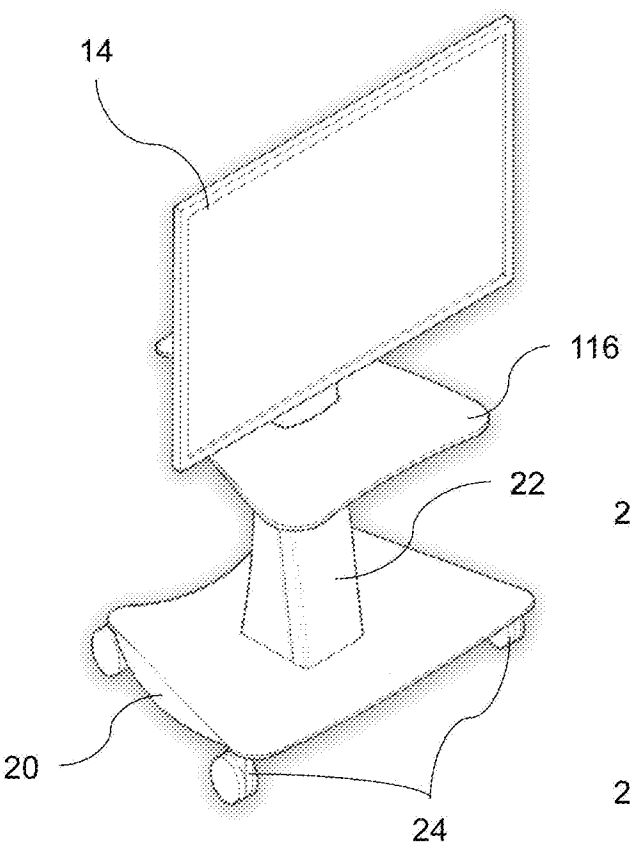

Referring now to the drawings and the illustrated embodiments depicted therein, a portable or movable work station or assembly 10 includes a movable stand or cart 12 with one or more monitors or display devices 14 and a tray or shelf or work surface 16 mounted thereat (FIG. 1). The movable stand 12 accommodates one or more batteries or battery packs or power sources 18 for delivering power to the one or more monitors 14 mounted to the stand 12 and to one or more user devices positioned at the work surface 16 (e.g., a laptop computer, tablet computer, mobile phone, light sources and the like). Because the movable stand 12 accommodates the one or more batteries 18, the work station 10 may be moved freely within an environment (e.g., an office or work place, a school or classroom, a retail location, a hospital, and the like) and does not require a cord plugged into an electrical outlet to supply power to the monitors 14 and user devices at the work station 10. Further, the modular design of the work station 10 allows the stand 12 to be compatible with a variety of different monitors 14 and user devices, which allows the work station 10 to be reconfigured based on the needs of the user within the environment.

The movable stand 12 includes a base or platform 20 and a column 22 extending upward from the base 20. Wheels or casters 24 (e.g., four lockable wheels or casters) are attached to the base 20 and allow the work station 10 to be moved within the environment. For example, the stand 12 may be moved within the environment by the user pushing or pulling the column 22 (e.g., by grasping the work surface 16 or a handle 30 disposed at the column) with the wheels 24 pivoting to allow for movement in a 360 degree range of motion. The wheels 24 may be suitably large and/or durable to allow the movable stand 12 to be moved over door thresholds and other bumps or obstacles. The base 20 may comprise a suitably heavy and durable construction (e.g., the base may be constructed from steel plates, such as ¼ inch steel plates, or wood plates) so that the work station 10 has a relatively low center of gravity for stability.

Figure 10:
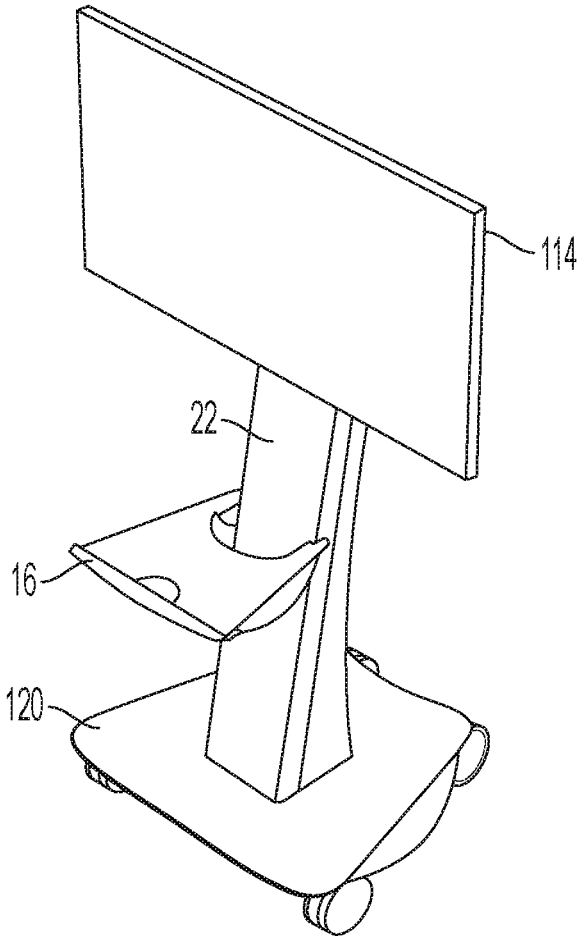
Figure 11:
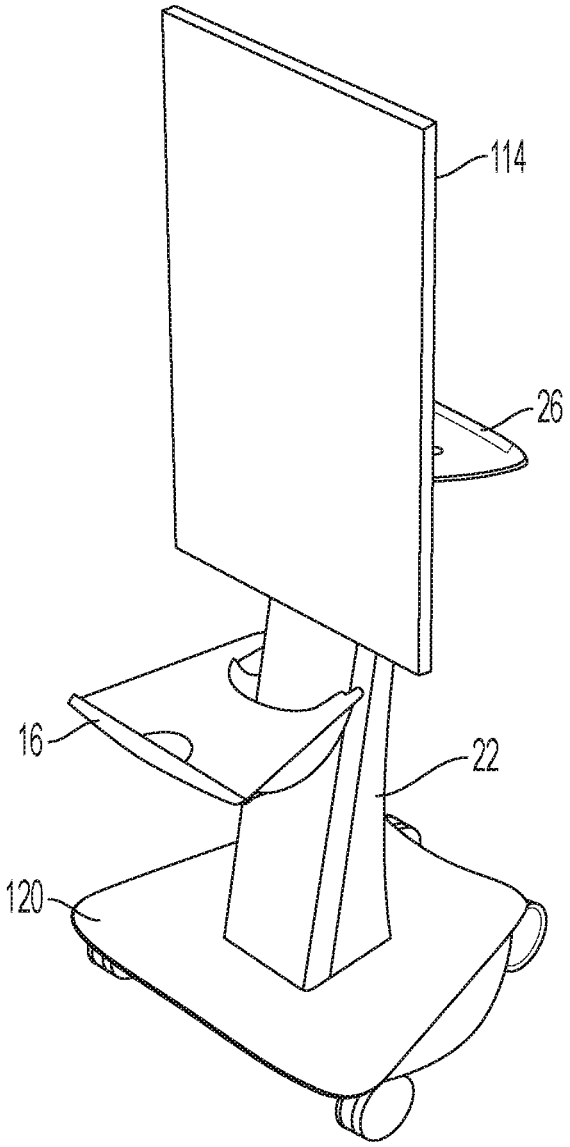
FIG. 11 is a perspective view of the portable work station of FIG. 10, with the monitor pivoted to a vertical position.

A mounting bracket or plate 26 is mounted at an upper end or head of the column 22 and a knuckle 28 may be pivotably attached to the mounting bracket 26. The knuckle 28 is configured to mountably receive the one or more monitors 14 and thus allows the monitor 14 to be tilted or pivoted relative to the column 22 (e.g., up and down and/or left and right) or swiveled or rotated at the top of the column between a horizontal orientation (e.g., FIG. 10) and a vertical orientation (e.g., FIG. 11). In other words, the monitor 14 may attach to the knuckle 28 and the knuckle 28 may tilt and/or pivot relative to the mounting plate 26 to enable movement of the monitor 14 relative to the column 22. The mounting plate 26 and knuckle 28 may provide a Video Electronics Standards Association (VESA) monitor mounting system. Further, the mounting plate 26 may include the handle portion 30 configured to be grasped by the user when moving the work station 10 within the environment. Holes or vents formed through the mounting plate 26 at the upper end of the column 22 and/or holes or vents formed through the base 20 at or near a lower end of the column 22 may allow for airflow through the column 22 to dissipate heat generated during operation of the battery packs 18.

The work surface 16 is removably attached along a first or front side or surface of the column 22 and the column 22 may include a plurality of mounting points for the work surface 16 spaced apart along the column 22 so that the work surface 16 may be mounted at a variety of different heights. For example, the work surface 16 may include arms or tabs 16*a* that extend from opposing sides of the work surface 16 and that are received in respective slots 22*a* along the front side of the column 22. Thus, with the monitor 14 mounted at the mounting bracket 26 and/or knuckle 28 at the upper end of the column 22, and when the user is operating the user device at the work surface 16, the monitor 14 may be positioned at or near or above the head of the user (e.g., so that the user may view the monitor or so that the monitor may display images to viewers standing behind the user), and the work surface 16 may be disposed along the column 22 below the monitor 14 and accessible for use by the user (such as to type on a keyboard or laptop computer disposed at the work surface).

The one or more batteries or battery packs 18 may be disposed at the base 20 (e.g., below an upper surface of the base) or accommodated within the column 22 so as to be hidden from view. Further, power cords extend along the column 22 between the battery pack 18 and the monitor 14 at the upper end of the column 22 and/or the user device at the work surface 16 to supply power from the battery pack 18 to the monitor 14 and the user device and to provide connectivity between the user device at the work surface 16 and the monitor 14. For example, the battery pack 18 may be electrically connected to one or more electrical outlets accessible at the exterior of the column 22 (e.g., one or more USB-A and/or USB-C outlets), such as at or near the work surface 16 or along a rear or back surface of the column 22. The column 22 may include a single piece back that is configured to accept one or more electrical components, such as power supplies that convert AC to DC power, batteries that can be daisy-chained, USB-A and USB-C DC connecting points for computer equipment, constant voltage transformers for powering monitors, IEC cord attachment, inverters for converting DC power to AC power for high-wattage monitors, AC power outlets (e.g., a triplex version for 120V), and the like. The back side of the column 22 may include connection locations, such as for wire ties to assist with cable management and connection of electronic devices at the work station 10.

The power cords, battery pack 18 and any other electronics may be disposed within the column 22 and hidden from view. The battery pack 18 may be removable from the work station 10, such as to be recharged or replaced with another, charged battery pack 18. Optionally, a power cord (e.g., a six foot power cord) may be connected to the battery pack and configured to extend from the work station 10 to plug into a power source, such as a standard electrical wall outlet, for charging the battery pack 18, and the power cord may be stored at the base 20 and/or along the column 22. The work station 10 may utilize battery bypass technology, where the monitor 14, user device and other electronic components and outlets draw power from the wall outlet when the work station 10 is plugged in to the outlet instead of drawing power from the battery pack 18 while the battery pack charges. Optionally, the battery pack may have a charging controller that is configured to provide slow-charge controls, where the battery pack recharges slowly (e.g., such as overnight), such as to preserve battery life. For example, the battery pack may retain 90 percent or more of its initial capacity even after 10,000 charging cycles.

Figure 12:
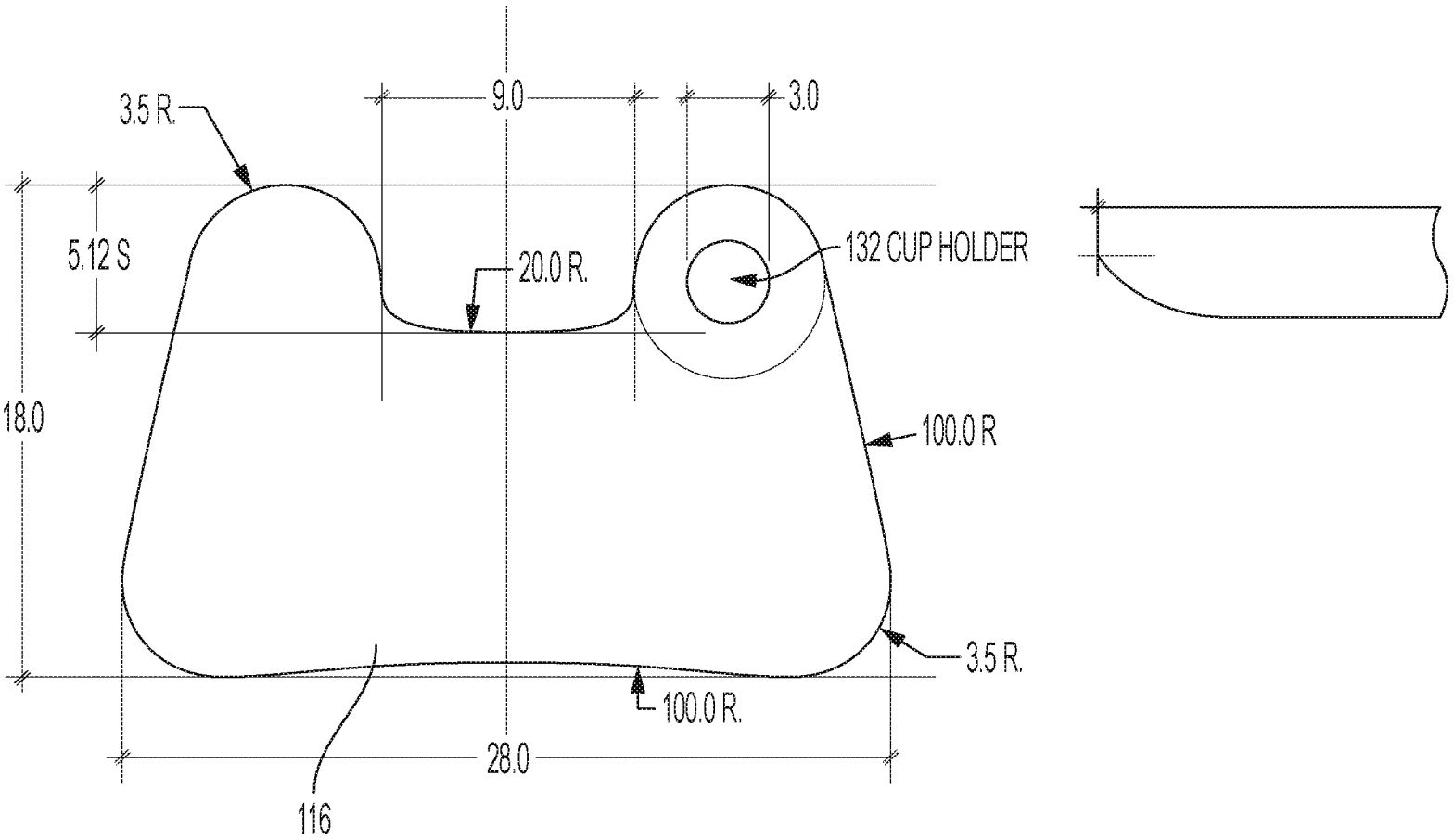
FIG. 12 is a plan view of the work surface, showing example dimensions of the work surface.

As shown in FIGS. 2-11, the work station 10 provides a modular design that is reconfigurable based on the needs of the user. That is, with the mounting plate 26 and knuckle 28 attached at an upper end of the column 22 and the battery pack 18 and power system accommodated within the column 22, the column 22 is configured to receive different bases, different monitors, and/or different work surfaces. For example, the work station may include a first or larger base 20 (e.g., FIGS. 2, 3, 8, 9 and 15) or a second or smaller base 120 (e.g., FIGS. 4-7, 10, 11 and 15), where the larger base 20 is larger (e.g., wider and/or heavier) than the smaller base 120. Thus, the larger base 20 may provide greater stability than the smaller base 120. The larger base configurations may be intended for use with larger size monitors 14 (e.g., monitors up to the 85 inch class size) and the smaller base configurations may be intended for use with smaller size monitors 114 (e.g., monitors up to the 45 inch class size). Further, the work station 10 may accommodate two or more monitors at the mounting bracket (e.g., FIG. 5), such that the two or more monitors may be mounted side by side or vertically adjacent one another. Moreover, the work station 10 may be configured to receive any suitable work surface or shelf, such as the smaller work surface 16 that is mounted via its arms or tabs received in the slots along the column 22 (e.g., FIGS. 3, 6-11 and 15), or a larger work surface 116 that may partially extend or wrap around the sides of the column 22 (e.g., FIGS. 2, 4, 5, 12 and 15). The work surface may be positioned at any suitable height along the column 22, such as at a sitting height (i.e., where the user may use the work surface while sitting down) or a standing height (i.e., where the user may use the work surface while standing). As shown in FIG. 12, the larger work surface 116 may include a through hole or passageway 132, which may be used as a cup holder, for cable pass through, or configured to receive an insert like a grommet having power outlets.

Figures 4, 5, 6, 7:
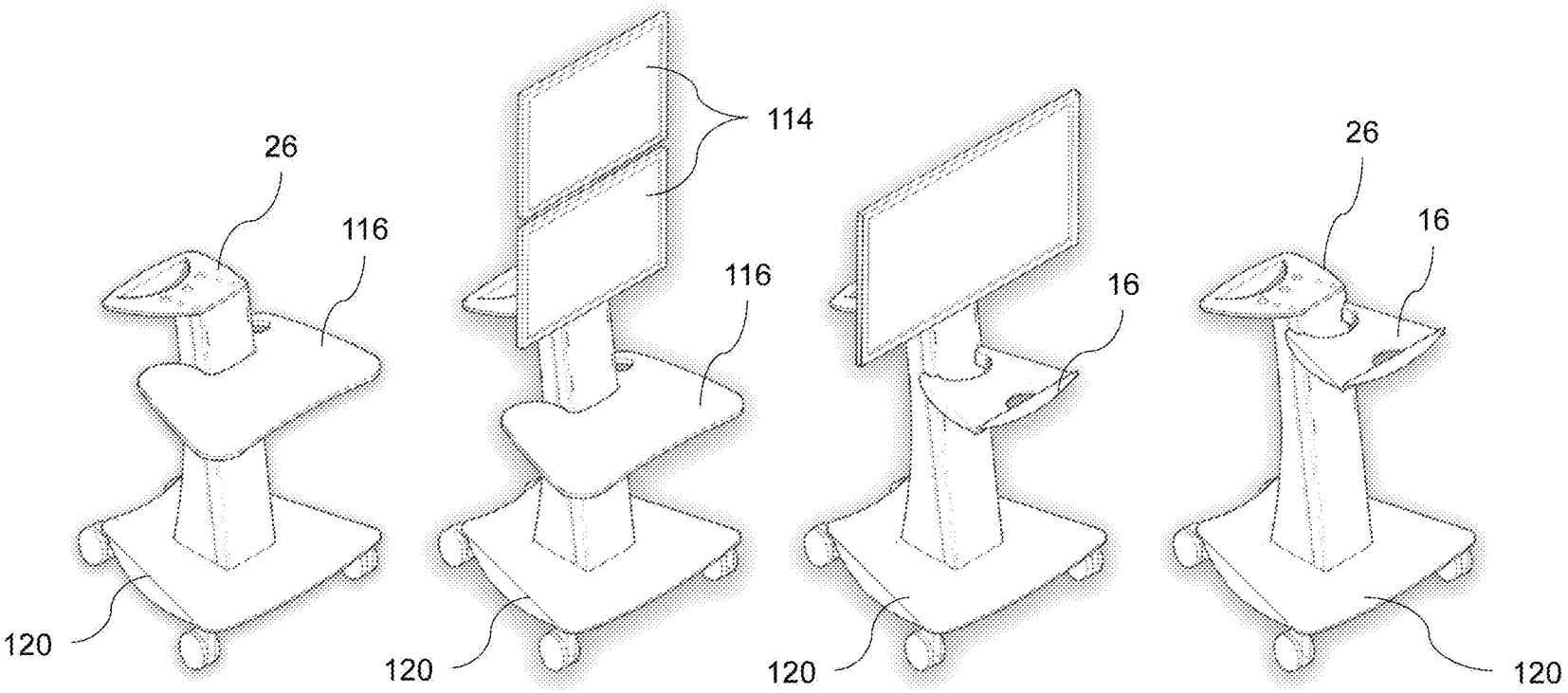
Figure 8:
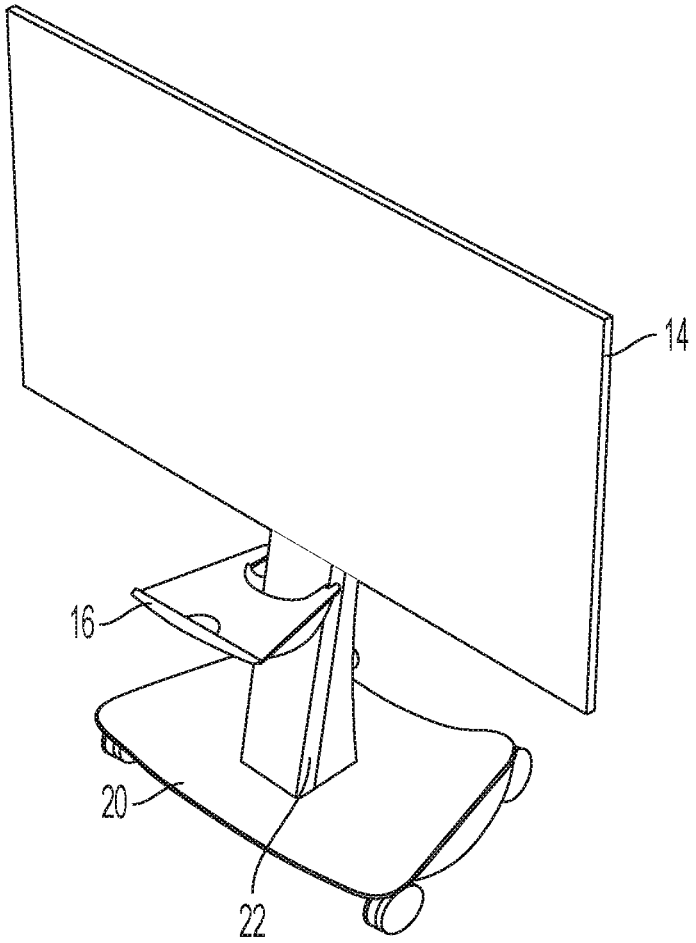
Figure 9:
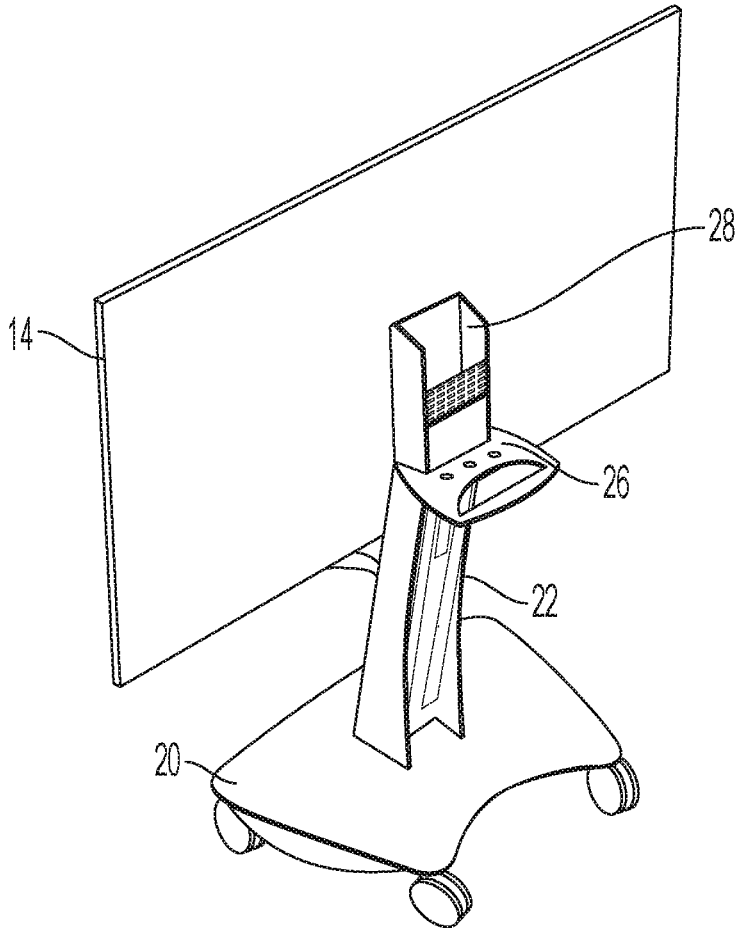

Optionally, the knuckle 28 and/or monitor 14 may be removable from the top of the column 22 and the work station 10 may be used as a portable power source and work surface 16 (e.g., FIGS. 4 and 7). In other words, with the monitor 14 removed from the work station 10, the work station 10 may be moved within the environment and the battery pack 18 may supply power to one or more user devices, such as a user device at the work surface 16.

In other words, the work station may be available in multiple solutions, such as based on desired monitor size, power storage and stability. Further, the work station may be used as a simple power source, such as when user devices require power at a location within the environment that does not have an available electrical outlet or during a power interruption or outage. The work station with the small base may be configured to mountably receive smaller monitors (e.g., monitors that are 45 inches diagonal or less) and the work station with the large base may be configured to mountably receive larger monitors (e.g., monitors that are 85 inches diagonal or less). The laptop tray or work surface may be assembled in multiple positions on the column.

The laptop tray or work surface may be removably assembled in one or more locations along the column, such as at a sitting or standing height. The work surface allows the stand to be used as a mobile work station.

Figure 13:
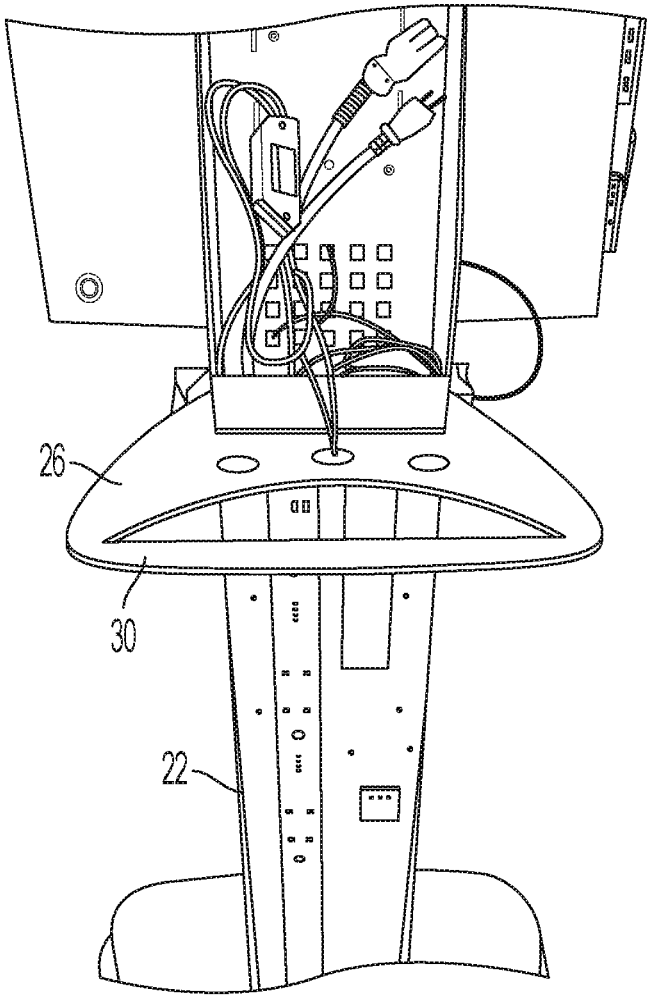
FIG. 13 is a perspective view of the portable work station, with a back plate of the column removed to show cable management of the battery pack accommodated by the column.

The rugged steel construction of the work station ensures a low center of gravity. Further, a large handle (e.g., capable of being grasped with two hands by the user) ensures improved stability in the event of encountering an obstacle during transit. That is, a handle assembly (e.g., at the mounting plate) assists the user in moving the work station from location to location. As shown in FIG. 13, there may be cable pathways or passageways through the mounting plate or handle to neatly manage cords and cables between the monitor, the power system and/or a user device at the work surface. Cords and cables may pass through respective apertures or passageways in the column for connection between the battery pack and the monitor and/or user device at the work surface.

The capacity of the battery pack 18 may be adjusted or selected based on power requirements of the monitor and user device disposed at the work station 10. For example, large monitors tend to correlate to higher power requirements. Thus, the work station may include a power capacity of 200 Watt-hours or more, 600 Watt-hours or more, 1,200 Watt-hours or more, and the like. The work station may include a high-efficiency 200 Watt inverter that converts DC power from the battery pack to AC power, and the inverter may be connected to a triplex outlet at the work station for electrically connecting to the monitor and/or user device. The inverter may include a variable speed fan that adjusts its speed based on the power drawn by the monitor to reduce noise.

The battery pack 18 may comprise any suitable number and configuration of power sources. For example, the battery pack may include one or more lithium ion power sources and provide capacity for extended operation, such as a 200 Watt-hour capacity or greater, a 600 Watt-hour capacity or greater and the like. The battery packs and power system may include characteristics of the battery packs and power systems described in U.S. Pat. Pub. No. US-2022-0251832 and/or U.S. patent application Ser. No. 18/604,565, filed Mar. 14, 2024 and published on Sep. 19, 2024 as U.S. Pat. Pub. No. US-2024-0313560, which are hereby incorporated herein by reference in their entireties.

Figure 14:
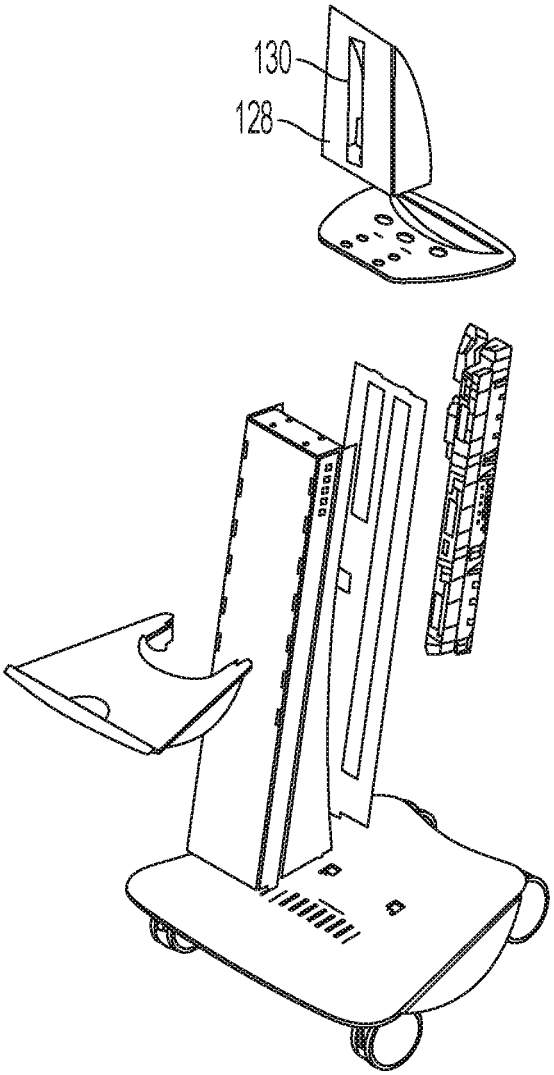
FIG. 14 is an exploded view of another portable work station with a mounting bracket that accommodates the monitor at a plurality of different heights relative to the column of the portable work station.
Figure 15:
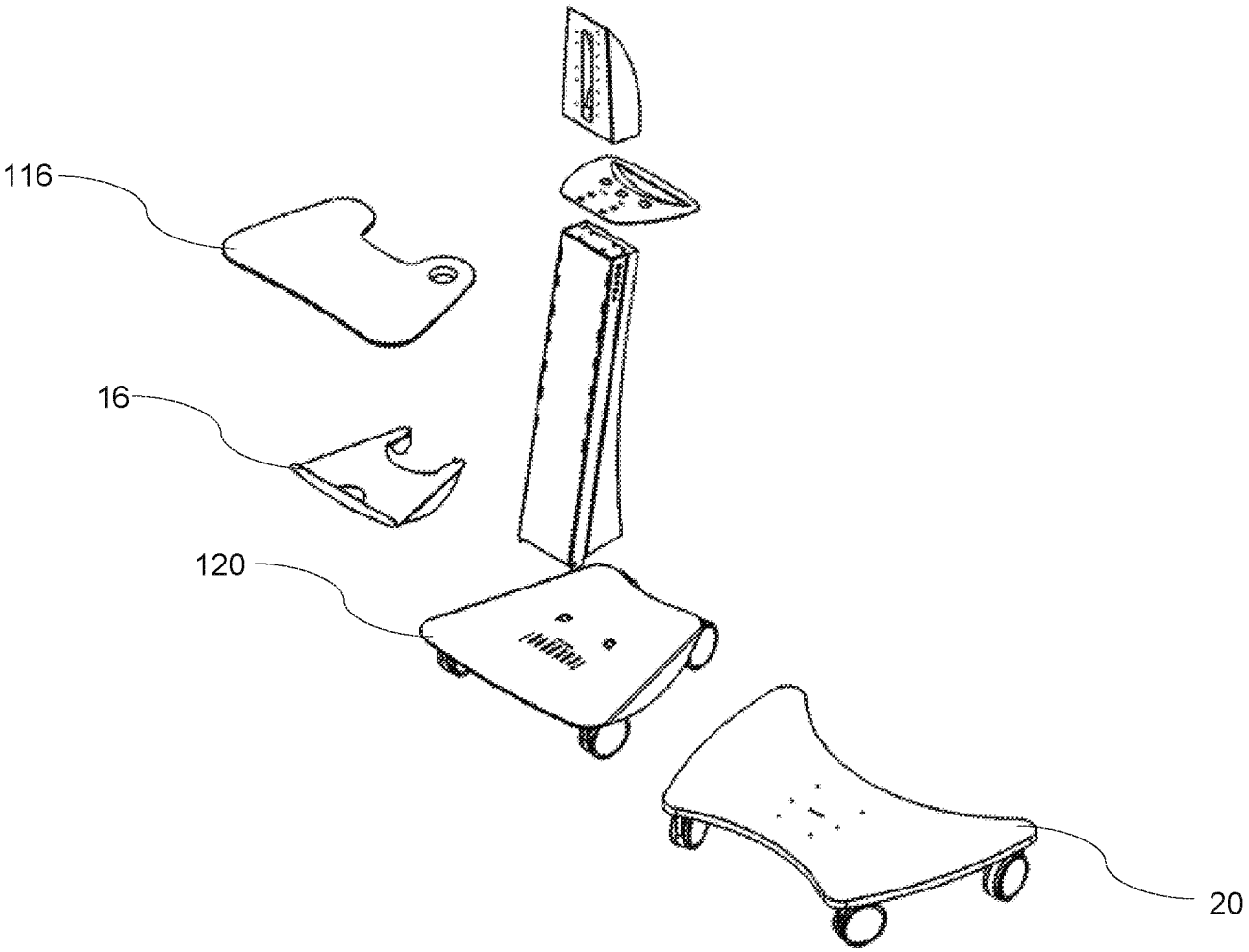
FIG. 15 is an exploded view of another portable work station with two example configurations of the base and two example configurations of the workspace.

Optionally, and such as shown in FIG. 14, the work station includes a mounting bracket 128 at the upper end of the column (e.g., at the mounting plate) that includes a plurality of mounting positions so that the monitor can be mounted at one of a plurality of different mounting heights and/or orientations. For example, the mounting bracket 128 includes a vertically extending slot 130 so that the monitor may be mounted at different heights along the mounting bracket 128 with the power cord and/or other connection cables extending through the slot between the monitor and the interior of the column. Thus, the user may select the height at which they want to mount the monitor to the work station. Further, the mounting bracket 128 may comprise a tilt-only VESA mount so that, with the monitor mounted at the tilt-only mount 128, the monitor is tiltable relative to the column (e.g., up and down and/or left and right), but the monitor is not pivotable or rotatable relative to the column (e.g., the monitor may not be rotated between horizontal and vertical orientations).

Thus, the modular cordless mobile cart or work station system is configured to receive one or more monitors or display devices and accommodates a battery pack or power system for powering the monitor. The work station hides and contains power cords extending between the power system and monitor (and optionally one or more user devices at the work surface of the work station) to allow the work station to be moved freely and provide mobile power within the environment. That is, all electrical wiring and cord management is routed to the back to enable a clean, untangled front to the unit. There are slots on the front of the column that allow for multiple shelves, and/or attachment of a work surface.

The components (e.g., the base, the column, the work surface, the mounting plate, the knuckle, the wheels and the like) may be detachable from one another so that the work station may be compactly packaged and easily assembled. That is, the work station may ship in a substantially flat configuration.

Figure 16:
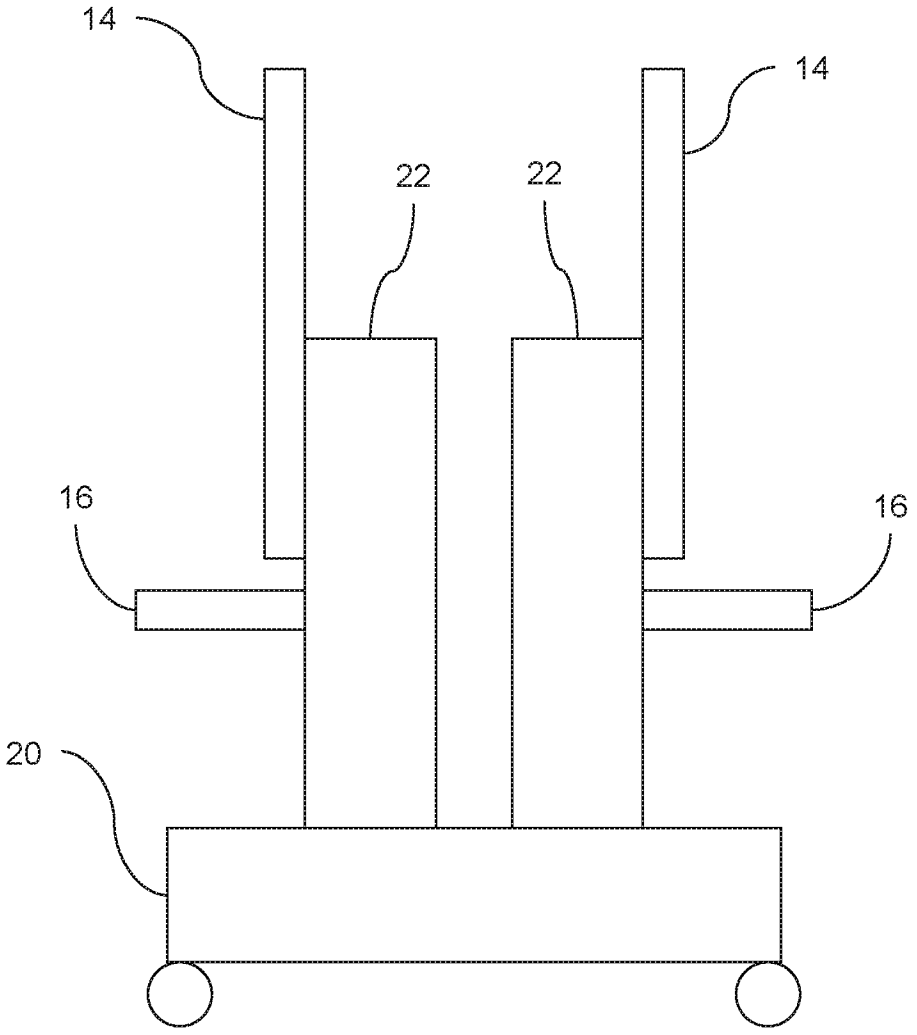
FIG. 16 is a schematic view of the portable work station including multiple columns.

Optionally, the work station includes multiple columns 22 (e.g., two or more columns) extending from the base 20, with each column 22 supporting one or more respective monitors 14 (FIG. 16). For example, the one or more columns 22 may allow for a first work surface 16 and first monitor 14 to be mounted along a front side of the work station and a second work surface 16 and second monitor 14 to be mounted along a rear side of the work station so that the work station may accommodate two users working simultaneously at the work station. Other configurations are possible, such as a work station configured for three or more users, four or more users, and the like. Thus, the work station with multiple columns may provide a mobile, multiple-monitored system with a plurality of work surfaces.

The work station may be suitable for use in office settings (e.g., as a portable work station, a presentation display, an announcement board and the like), in retail settings (e.g., to provide digital signage, a retail store display, digital advertising, an ordering kiosk, a digital menu board and the like), in manufacturing or workshop settings, in classroom settings, in outdoor settings and the like. For example, the work station may provide a monitor and laptop tray so that the battery pack may power the monitor and a laptop at the laptop tray, such as for use at a trade show or convention.

Changes and modifications in the specifically described embodiments can be carried out without departing from the principles of the invention, which is intended to be limited only by the scope of the appended claims, as interpreted according to the principles of patent law including the doctrine of equivalents.

The invention claimed is:

1. A portable work station, the portable work station comprising:

a base, wherein the base includes a plurality of wheels for moving the portable work station within an environment;

a column extending from the base, wherein a mounting plate is disposed at an end of the column distal from the base;

a battery pack accommodated by the column, wherein the battery pack is operable to electrically power one or more electronic devices disposed at the portable work station;

wherein the column comprises a single-piece back, and wherein the battery pack and one or more electronic components are attached to the single-piece back and accommodated within the column;

a monitor removably mounted at the mounting plate, wherein the battery pack is operable to electrically power the monitor; and wherein, with the monitor removably mounted at the mounting plate, a power cord of the monitor extends within the column and between the battery pack and the monitor for electrically powering the monitor.

2. The portable work station of claim 1, comprising a work surface that removably mounts along the column.

3. The portable work station of claim 2, wherein the column comprises a plurality of mounting structures disposed along the column between the base and the end of the column distal from the base, and wherein the plurality of mounting structures are configured to mount the work surface at corresponding positions along the column.

4. The portable work station of claim 3, wherein the plurality of mounting structures comprise a plurality of slots on a front of the column, and wherein the plurality of slots allow for mounting of a plurality of work surfaces at the corresponding positions along the column.

5. The portable work station of claim 2, wherein the battery pack, with a user device disposed at the work surface, is operable to electrically power the user device.

6. The portable work station of claim 1, wherein the battery pack is electrically connected to an electrical outlet accessible exterior the column, and wherein the battery pack supplies electrical power to the electrical outlet to electrically power the one or more electronic devices disposed at the work station.

7. The portable work station of claim 6, wherein the electrical outlet comprises one selected from the group consisting of (i) a USB-C type outlet, (ii) a USB-A type outlet and (iii) a triplex type outlet.

8. The portable work station of claim 6, wherein an inverter is electrically connected between the battery pack and the electrical outlet and converts DC power from the battery pack to AC power supplied to the electrical outlet.

9. The portable work station of claim 1, wherein the mounting plate comprises a handle portion configured to be grasped by a user when the user moves the portable work station within the environment.

10. The portable work station of claim 1, wherein the base comprises a metal base platform.

11. The portable work station of claim 1, wherein the mounting plate includes a knuckle, and wherein the knuckle, with the monitor removably mounted at the mounting plate, enables the monitor to be tilted up/down and/or side to side relative to the column.

12. The portable work station of claim 1, wherein the mounting plate is removable from the end of the column distal from the base.

13. The portable work station of claim 1, wherein electrical wiring is routed to a back of the column to enable a clean, untangled front to the work station.

14. The portable work station of claim 1, wherein the monitor comprises two monitors removably mounted at the mounting plate and stacked relative to one another at the mounting plate.

15. The portable work station of claim 1, wherein a mounting bracket disposed at the mounting plate comprises a vertically extending slot for removably mounting the monitor along the vertically extending slot at a plurality of heights relative to the column.

16. A portable work station, the portable work station comprising:

a base, wherein the base includes a plurality of wheels for moving the portable work station within an environment;

a column extending from the base, wherein a mounting plate is disposed at an end of the column distal from the base;

a battery pack accommodated by the column, wherein the battery pack is operable to electrically power one or more electronic devices disposed at the portable work station;

a monitor removably mounted at the mounting plate, wherein the battery pack is operable to electrically power the monitor; and wherein the column comprises a first column and a second column, and wherein the monitor comprises a first monitor removably mounted at the first column and a second monitor removably mounted at the second column.

17. A portable work station, the portable work station comprising:

a base, wherein the base includes a plurality of wheels for moving the portable work station within an environment;

a column extending from the base, wherein a mounting plate is disposed at an end of the column distal from the base;

wherein the mounting plate includes a knuckle and a handle portion, and wherein the handle portion is configured to be grasped by a user when the user moves the portable work station within the environment;

a work surface removably mounted along the column;

a battery pack accommodated by the column, wherein the battery pack is operable to electrically power one or more electronic devices disposed at the portable work station;

wherein the column comprises a single-piece back, and wherein the battery pack and one or more electronic components are attached to the single-piece back and accommodated within the column;

a monitor removably mounted at the mounting plate, wherein the battery pack is operable to electrically power the monitor, and wherein the knuckle of the mounting plate enables the monitor to be tilted relative to the column; and wherein, with the monitor removably mounted at the mounting plate, a power cord of the monitor extends within the column and between the battery pack and the monitor for electrically powering the monitor.

18. The portable work station of claim 17, wherein the column comprises a plurality of mounting structures disposed along the column between the base and the end of the column distal from the base, and wherein the plurality of mounting structures are configured to mount the work surface at corresponding positions along the column.

19. The portable work station of claim 18, wherein the plurality of mounting structures comprise a plurality of slots on a front of the column, and wherein the plurality of slots allow for mounting of a plurality of work surfaces at the corresponding positions along the column.

20. The portable work station of claim 17, wherein the battery pack is electrically connected to an electrical outlet accessible exterior the column, and wherein the battery pack supplies electrical power to the electrical outlet to electrically power the one or more electronic devices disposed at the work station.

* * * * *